United States Patent [19]

Benedetti

[11] 4,368,030

[45] Jan. 11, 1983

[54] CIGARETTE LIGHTER PROVIDED WITH A DEVICE FOR SIGNALLING THE NUMBER OF LIGHTINGS EFFECTED AND THE TIME INTERVAL BETWEEN TWO SUBSEQUENT LIGHTINGS

[76] Inventor: Laura Benedetti, Lungadige Catena 3, Verona, Italy

[21] Appl. No.: 234,718

[22] Filed: Feb. 17, 1981

[30] Foreign Application Priority Data

Feb. 18, 1980 [IT] Italy ..... 19978 A/80

[51] Int. Cl.[3] ..... F23D 5/12

[52] U.S. Cl. ..... 431/13; 368/10

[58] Field of Search ..... 431/13, 15, 253; 368/10–19; 364/705; 340/309.1

[56] References Cited

U.S. PATENT DOCUMENTS 3,744,953 7/1973 Herr ..... 431/13

4,111,638 9/1978 Ostberg ..... 431/13

*Primary Examiner*—William E. Wayner

*Attorney, Agent, or Firm*—Anthony Pellicano

[57] ABSTRACT

The cigarette lighter according to the invention comprises a pulse counter connected with a display and actioned by shutting the lighter cap.

With the display there is also connected a timer, always operational, which is automatically set to zero when the figure indicated by the pulse counter moves one unit forward.

In this way it is possible to control both the number of times the lighter has been used and the time interval between one lighting and the subsequent.

2 Claims, 2 Drawing Figures

CIGARETTE LIGHTER PROVIDED WITH A DEVICE FOR SIGNALLING THE NUMBER OF LIGHTINGS EFFECTED AND THE TIME INTERVAL BETWEEN TWO SUBSEQUENT LIGHTINGS

The present invention relates to a cigarette lighter provided with a device allowing to control both the number of lightings effected and the time interval between one lighting and the subsequent one.

This is possible thanks to a digit display connected with miniaturized devices and housed preferably inside the lighter case.

The above device may be usefully employed to check the number of cigarettes one has smoked e.g. in the space of a day and/or to control the time that has elapsed since he lit the last cigarette.

To this end the invention provides for a lighter, comprising a preferably integrated-circuit counter, fed by a battery and automatically actioned for instance each time, after using the lighter, its cap is shut down.

The digit display of a timer is automatically set to zero as the counter moves a figure forward, allowing thus to know how much time has passed since the lighter was last used.

The present invention will be now described in detail, by mere way of non-limiting example, with particular reference to the accompanying drawings, wherein.

Figure 1:
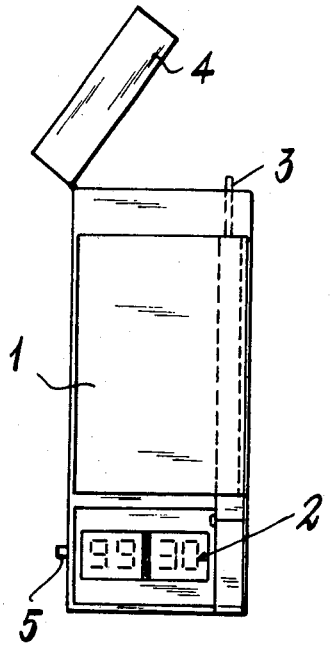
FIG. 1 shows a lighter according to the invention.

In the body 1 of a lighter according to the invention (FIG. 1) there is inserted a display 2 (that of the drawing is made of 4 figures), linked to a preferably electronic circuit placed inside the lighter case, and which will be described later.

From the upper edge of body 1 there extends a pushbutton 3 or the like which is pressed by cap 4 when the same is shut down.

The function of pushbutton 3 is that of controlling a counter linked to display 2.

From the lighter there extends also a second pushbutton 5, which is for setting display 2 to zero.

Figure 2:
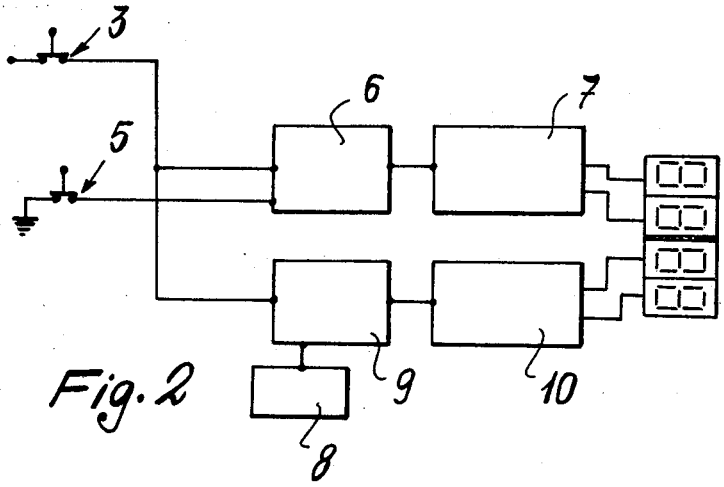
FIG. 2 is a block diagram of an electronic circuit inserted into the lighter according to the invention.

The electronic circuit, indicated by a block diagram in FIG. 2, consists of a binary scaler 6, connected with display 2 by means of a decoder 7, and acting upon two figures of same display in order to show the number of times the lighter has been actioned.

Binary scaler 6 receives an impulse whenever cap 4, being shut down, presses pushbutton 3. In this way, every time the lighter cap is shut, the figure showing at the display moves one unit forward.

It is then possible to set the display to zero by acting on the zeroing pushbutton 5.

Another element of the circuit is a quartz oscillator 8, connected with a counter 9 which in turn acts upon the remaining figures of display 2 through a decoder 10.

Said oscillator is always in function while the figures indicating the time on the display are automatically set to zero when pushbutton 3 is pressed by shutting the cap.

Thus, every time the lighter cap is shut down, the timer, which is zero adjusted, is ready to start anew, while the figure indicating the number of lightings effected moves one unit forward. To set even this one to zero it is sufficient to press pushbutton 5.

One skilled in the art may then provide for many changes or variations, none of which, though, should depart from the ambit of the present invention.

What is claimed is:

1. A cigarette lighter characterized by the fact of providing a pulse counter actioned by shutting the lighter cap and linked to a display, and providing as well a timer, also linked to a display, and means for automatically setting said timer to zero when the figure shown by said counter moves one unit forward at the shutting of the cap.

2. A lighter according to claim 1, characterized by the fact of providing a circuit consisting of a counter 6, connected with a display 2 by means of a decoder 7, and an oscillator 8 linked to a timer 9 which is in turn linked, through a decoder 10, to display 2, said timer being set to zero, by means of the same control, each time the figure shown by counter 6 moves one unit forward.

* * * * *